United States Patent [19]

Wade et al.

[11] 4,051,798

[45] Oct. 4, 1977

[54] SELF-LOCKING CABLE TROLLEY

[75] Inventors: Mark W. Wade, West Palm Beach; Donald A. Goodrum, Delray Beach, both of Fla.

[73] Assignee: James Nemec, West Palm Beach, Fla. ; by said Donald A. Goodrum

[21] Appl. No.: 676,544

[22] Filed: Apr. 13, 1976

[51] Int. Cl.[2] ..... B63B 21/08

[52] U.S. Cl. ..... 114/199; 24/130; 114/102; 188/65.1

[58] Field of Search ..... 114/102, 104–108, 114/113, 114, 199, 210; 24/115 R, 115 H, 130; 188/65.1–65.5; 212/106, 109, 122; 254/192, 195

[56] References Cited

U.S. PATENT DOCUMENTS

| | | | |
|---|---|---|---|
| 213,165 | 3/1879 | Brice | 188/65.1 |
| 3,186,372 | 6/1965 | Cleveland | 114/199 |
| 3,470,982 | 10/1969 | Warden, Jr. | 188/65.2 |
| 3,851,610 | 12/1974 | Greene | 114/106 |
| 3,958,523 | 5/1976 | Holmes et al. | 114/106 |
| 3,964,419 | 6/1976 | Vecker | 114/106 |

*Primary Examiner*—Trygve M. Blix
*Assistant Examiner*—Stuart M. Goldstein
*Attorney, Agent, or Firm*—Clarence A. O'Brien; Harvey B. Jacobson

[57] ABSTRACT

A self-locking cable trolley having a body member which guidingly receives a cable on which the body member rides and a length of working line that permits control of the body member on the cable. Disposed on the body member is a lock device which grips the supporting cable when the working line is manipulated in a predetermined manner so as to cooperate with a control surface also provided on the body member and swing the lock device into engagement with the cable in order to selectively retain the body member of the trolley at a desired location on the cable.

10 Claims, 4 Drawing Figures

SELF-LOCKING CABLE TROLLEY

BACKGROUND OF THE INVENTION

1. Field of the Invention

This invention relates generally to a cable trolley, and particularly to a self-locking cable trolley particularly suited for use on the head stay of a sailboat, and the like, for manipulation by a working line attached to the luff of an associated sail in order to eliminate sag which may be in the sail.

2. Description of the Prior Art

A problem arises in the popular sport of sailing of keeping the jib sail from sagging relative to its associated head stay cable. While the common approach to eliminating sag from the jib is to tie the luff of the jib to the associated head stay, on larger boats especially it is difficult to reach the appropriate point in the jib and tie a tensioning line between the luff of the jib and the head stay. Further, it is becoming conventional to provide the jib with a furling cable passing along the luff of the jib in order to facilitate furling of the jib sail as by means of a furling drum. The use of such devices as furling drums are becoming extremely popular as they permit a relatively large sailboat to be crewed by only one or two persons. Thus, the problems associated with a sagging jib luff become even more important, inasmuch as such sagging places undesirable stresses on the furling cable and the fittings and bearings associated with the furling cable.

Accordingly, it is advantageous to provide a cable trolley which can be run up and down the head stay of a sailboat in order to place appropriate tension on a line attached to the luff of a sail associated with the head stay in order to remove sag from the sail.

Known cable trolleys, however, are not suitable to such an application. For example, U.S. Pat. No. 75,946, issued Mar. 24, 1868 to Miller, discloses a pulley block arrangement in which the weight of the load being lifted moves the pulleys into clutching engagement with a rope on which the pulley block arrangement is riding, with the pulley block being pivoted to its release position when the load is completely elevated. Such a load-responsive device, however, would have no application where it is desired to retain a cable trolley in a certain position in order to eliminate sag from a sail of a sailboat. While U.S. Pat. No. 408,702, issued Aug. 13, 1889 to Fiske, dislcoses a pulley arrangement which includes a clutch actuated by a separate length of line other than the line upon which the pulley arrangement is riding, the device is, like U.S. Pat. No. 75,946 discussed above, responsive to a load on the same endless length of cable on which the pulley arrangement is riding.

We are aware of the following additional patents that may be pertinent to the invention:

U.S. Pat. No. 623,328 filed on Apr. 18, 1899;
U.S. Pat. No. 3,470,982 filed on Oct. 7, 1969;
U.S. Pat. No. 3,756,565 filed on Sept. 4, 1973.

SUMMARY OF THE INVENTION

It is an object of the present invention to provide a cable trolley capable of eliminating sagging of a sail.

It is another object of the present invention to provide a cable trolley of simple yet rugged and reliable construction capable of being employed on sailboats with minimum maintenance.

It is yet another object of the present invention to provide a cable trolley which is self-locking on the head stay of a sailboat, and which may be easily placed on and removed from a head stay of a sailboat.

These and other objects are achieved according to the invention by providing a self-locking cable trolley having: a body member including a first guide for receiving a cable on which the body member rides and guiding the body member along the cable, and a second guide for receiving a length of a working line; a lock device included in the first guide for selectively retaining the body member at a predetermined position on the cable; and a control arrangement included in the second guide and responsive to positioning of the working line for selectively actuating the lock device and retaining and releasing the body member relative to the cable.

The first guide advantageously includes a through passage in the body member, with the lock device including a block of resilient material arranged in the passage and provided with a groove which can grippingly receive the cable on which the body member is riding.

The control arrangment preferably includes a control surface about which the working line is pressed in order to pull the lock device away from the cable and accordingly disengage the member from the cable.

The control arrangement advantageously further includes a right-angle lead-in provided in a through passage included in the second guide for bending the working line at substantially a right angle. The lead-in provides a beaing surface for the working line at substantially right angles to a guiding direction of the first guide and forms an arrangement for permitting the working line to swing the body member about the cable and engage the lock device with the cable when the working line is free of the control surface. When the working line is pulled about the control surface, the body member is swung in the opposite direction in order to pull the lock device away from the cable and free the body member for movement up or down the cable as desired.

In the preferred application of the cable trolley according to the invention wherein the body member is mounted on the head stay of a sailboat for riding up and down the stay, the working line is connected to the luff of, for example, a jib of the sailboat in order that any sag may be eliminated from the jib. In this manner, the body member may be moved upwardly along the stay by pulling on the working line until the body member reaches a point substantially opposite the point of attachment of the working line to the luff of the sail. When the working line is released by a person standing on the deck or in the cockpit of the sailboat, the body member will of course slide down the stay under the influence of gravity.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
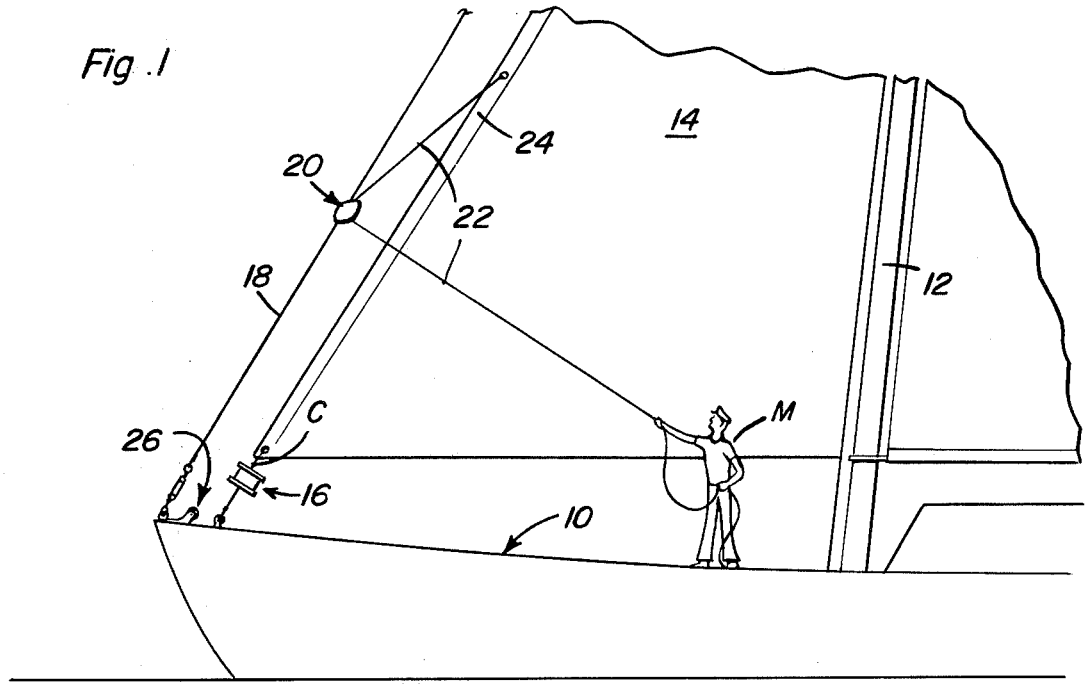
FIG. 1 is a fragmentary, schematic, side elevational view showing a cable trolley according to the present invention being employed on a sailboat.

Referring now more particularly to FIG 1 of the drawing, a conventional sailboat 10 is shown as having a mast 12 in front of which a sail 14, usually referred to as a jib, is arranged. A furling drum 16 is connected to a furling cable C in a conventional manner in order to permit furling of sail 14 without the necessity of a crewman leaving the cockpit of boat 10. Extending from the foremost end of the bow of boat 10 is a cable 18 usually referred to as a hard stay. The upper end of cable 18 is attached to mast 12 in a conventional manner not shown. Slidably mounted on cable 18 is a self-locking cable trolley 20 according to the invention. Trolley 20 guides a working line 22 attached to luff 24 of sail 14 for permitting sag in sail 14 to be drawn up to the head stay formed by cable 18 so as to, among other things, take stress off of the furling cable C and its associated fittings and bearings (not shown in detail herein, but of a conventional nature). A pulley sheave 26 is shown disposed between furling drum 16 and cable 18 at the bow of boat 10 so that working line 22 may be run therearound, in a manner not shown, and pass to the cockpit area of boat 10, which cockpit area is also not shown, so that the free end of line 22, shown being held by crewman M in FIG. 1, can be tied to a conventional cleat (not shown) and the like in order to hold trolley 20 in a desired position on cable 18 for an indefinite length of time.

Figure 2:
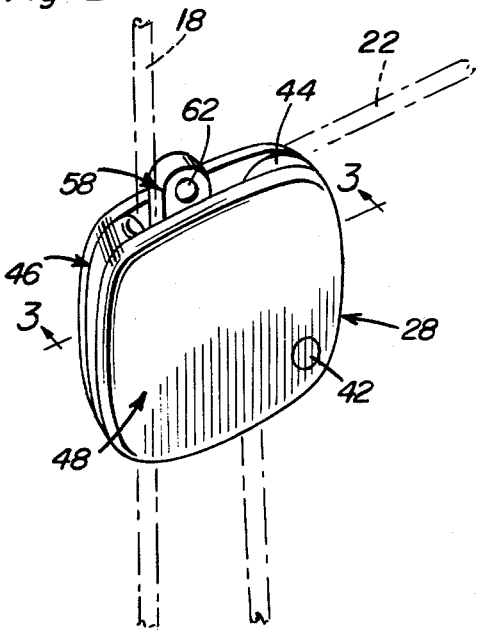
FIG. 2 is a perspective view showing a cable trolley according to the present invention.
Figure 3:
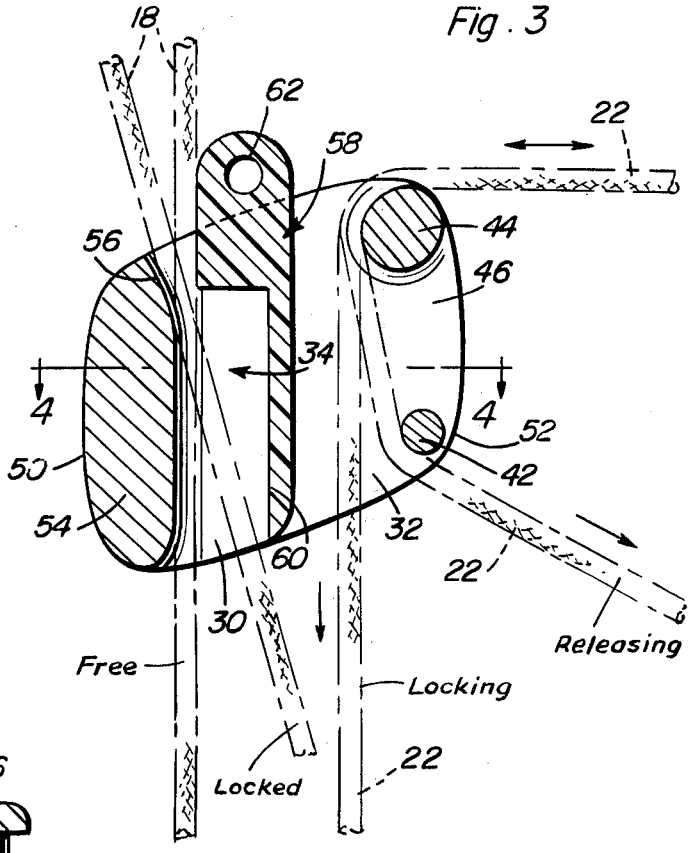
FIG. 3 is an enlarged sectional view taken generally along the line 3—3 of FIG. 2.
Figure 4:
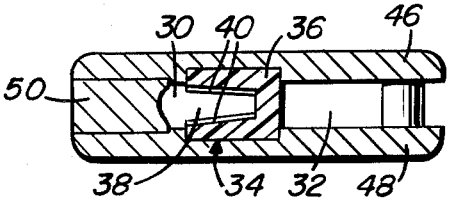
FIG. 4 is a sectional view taken generally along the line 4—4 of FIG. 3.

Referring now more particularly to FIGS. 2 through 4 of the drawing, trolley 20 includes a body 28 provided with a first guide in the form of a through passage 30 arranged for receiving cable 18 on which the body 28 rides and guiding body 28 along cable 18, and a second guide formed by a through passage 32 for receiving the length of working line 22. A lock device 34 is included in through passage 30 for selectively retaining body 28 at a predetermined position on cable 18, with this lock device 34 advantageously comprising a block 36 of a resilient material, such as a natural or synthetic rubber, provided with a wedge or V-shaped groove 38 arranged for grippingly receiving cable 18. Teeth 40 can be provided in groove 38 for transversely engaging cable 18 and increasing the frictional gripping force exerted on cable 18 by block 36. More specifically, Neoprene is a synthetic rubber which has been found satisfactory for constructing resilient block 36.

The second guide has partially defining passage 32 a control surface, which can be in the form of the illustrated control pin 42, for selectively actuating the lock device 34 and retaining and releasing body 28 relative to cable 18. In particular, working line 22 can be pressed against the surface formed by pin 42 in order to pull lock device 34, and more specifically resilient block 36, away from cable 18 and thus release lock device 34 and body 28 for sliding movement along cable 18. In addition, the second guide includes a, for example, friction sheave 44 partially forming passage 32 and providing a right-angle lead-in in passage 32 for bending working line 22 at substantially a right anlge. The lead-in thus formed provides a bearing surface for working line 22 at substantially a right angle to a guiding direction of the first guide, or passage 30, of cable 18 for permitting working line 22 to swing body 28 about cable 18 and engage lock device 34 with cable 18 when working line 22 is free of the pin 42. The latter position is shown by the broken line illustration of line 22 at the left of passage 32 in FIG. 3. Thus, it can be seen that working line 22, in addition to permitting body 28 to be pulled upwardly along cable 18 until the point of attachment of line 22 to sail 14 is reached, permits selective retention of body 28 at a desired location on cable 18 merely by pulling line 22 toward the rear, or aft, of boat 10.

Body 28 is constructed from a pair of spaced, substantially parallel, side plates 46 and 48 each having a front edge 50 and a rear edge 52, and between which adjacent the front edges 50 is disposed a front section 54 provided with a surface 56 forming a load edge and fulcrum for cable 18. This function can be appreciated from the left-most broken line showing of cable 18 in FIG. 3. Also disposed between plates 46 and 48 is a center section 58 which separates and partially forms through passages 30 and 32, and which is proivded with a substantially rectangular recess 60 which receives block 36 of lock device 34. Block 36 may be mounted on center section 58 as by a press-fit of the resilient block within the recess 60. As can be seen from FIG. 4, block 36 is disposed in recess 60 with groove 38 opening toward front section 54 of body 28.

As center section 58 is disposed substantially midway between the front edges 50 and rear edges 52 of plates 46 and 48, space is left adjacent rear edges 52 of plates 46 and 48 for disposition of control pin 42 and sheave 44.

While sheave 44 has been disclosed as being a friction sheave, and this is all that is required in most circumstances, it may be advisable under certain conditions to employ a pulley sheave in place of the friction sheave 44.

Center section 58 is advantageously provided with a portion extending above side plates 46 and provided with an eye 62 which may be connected to a cable (not shown) and the like for facilitating lifting of body 28 under certain conditions. For example, it may be desirable to lift body 28 above a point at which line 22 is connected to sail 14, and this lifting may be accomplished by attaching a cable (not shown) to eye 62 in a conventional manner and running the cable over a pulley block (not shown), and the like, disposed on, for example, mast 12 at a point above attachment of line 22 to luff 24 of sail 14.

While body 28 may be constructed from any suitable material, it is contemplated that in most instances body 28 would be constructed from a rigid synthetic resin, such as nylon. In certain instances, however, body 28 could be constructed in a conventional manner from a suitable metal, such as a stainless steel. Further, it is possible that by interchanging blocks 36 having different size grooves 38 within a single body 28, a single trolley 20 could serve several wire cable sizes.

Working line 22 should be of sufficient length to run from the selected point of attachment on luff 24 to the tack point defined by sheave 26 and back along the deck of boat 10 to be secured at a cleat (not shown) in the vicinity of the cockpit (not shown) of boat 10.

Line 22 could be attached to sail luff 24 via a bracket (not shown) or tied through a grommet inserted through the sail fabric. Attachment at luff 24 must include the furling cable C which runs through the forward edge of sail 14. The purpose of cable C is to roll up, or furl, sail 14 by rotation of furling drum 16 in a manner known per se. In application, working line 22 is fed through the tack location sheave and back along the deck of boat 10 to its cleating position near the cockpit.

Tension on working line 22 will then draw a sagging sail luff up to the head stay formed by cable 18. When it is desired to furl sail 14, working line 22 is released from the cockpit cleat and is allowed to run free along the deck of boat 10. Furling drum 16 may now be actuated and sail 14 rolled up as normally done with furling gear. The working line 22 will simply roll up with the sail 14.

In order to install trolley 20 on a head stay, which installation may be permanent until desired to remove the trolley entirely, cable 18 is passed through passage 30 either by freeing one end of cable 18 and passing it through the passage or by disassembling body 28 as by removal of one of the side plates 46, 48, and cable 18 is placed within passage 30 prior to reassembly of body 28. Next, working line 22 is passed through passage 32, and trolley 20 is sent into its working position by pulling on working line 22 away from the head stay. That is, line 22 is pulled toward the stern (not shown) of boat 10. Trolley 20 is then held in its working position by maintaining pressure on working line 22. While doing so, the installer will walk forward of boat 10 until the working line 22 is about parallel with the head stay formed by cable 18. Trolley 20 will then snap into its locked position. Additional locking is possible by thrusting the working line 22 forward past the head stay and thereby forcing cable 18 deeper into lock device 34.

To remove trolley 20 from cable 18, working line 22 is first freed from the tack location sheave 26, and is then tugged away from the cable 18, toward the stern of boat 10, as in the installation. This will snap trolley 20 out of its lock position and will permit body 28 to slide down the head stay.

As can be appreciated from the above description and from the drawing, a trolley constructed according to the invention is practical and economical. The highest stress point is where the head stay cable rides inside passage 30, and possible chafe on working line 22 may necessitate the use of a pulley sheave in body 28 rather than the friction sheave 44. Wear in the lock device 34 should be negligible, but a new resilient block 36 may be inserted if necessary.

Two or more trolleys could be used on very large sails. Also, an aluminum tube, and the like, may be inserted into a sail to spread the tensioning pull of line 22 through trolley 20 out over a longer length of the sail luff 24 to offset possible scalloping action in the luff of the sail.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A self-locking cable trolley, comprising, in combination:

a. a body member including first guide passage means for receiving a cable on which the body member rides and guiding the body member along the cable, and second guide passage means separated from the first guide passage means for receiving a length of a working line;

b. lock means included in the first guide passage means for selectively retaining the body member at a predetermined position on the cable; and c. control means included in the second guide passage means and responsive to positioning of the working line for selectively actuating the lock means and retaining and releasing the body member relative to the cable.

2. A structure as defined in claim 1, wherein the control means includes a control surface about which the working line is pressed in order to pull the lock means away from the cable.

3. A self-locking cable trolley, comprising, in combination:

a. a body member including first guide means for receiving a cable on which the body member rides and guiding the body member along the cable, and second guide means for receiving a length of a working line;

b. lock means included in the first guide means for selectively retaining the body member at a predetermined position on the cable; and c. control means included in the second guide means and responsive to positioning of the working line for selectively actuating the lock means and retaining and releasing the body member relative to the cable, the first guide member including a through passage provided in the body member, with the lock means including a block of resilient material provided with a groove and arranged for grippingly receiving the cable, the control means including a control surface about which the working line is pressed in order to pull the lock means away from the cable, the control means further including a right-angle lead-in provided in the body member for bending the working line, the lead-in providing a bearing surface for the working line at substantially right angles to a guiding direction of the first guide means and forming a means for permitting the working line to swing the body member about the cable and engage the lock means with the cable when the working line is free of the control surface.

4. A structure as defined in claim 3, wherein the body member includes a pair of spaced side plates each having a front edge and a rear edge, a front section disposed between the side plates at the front edge thereof, a portion of the front section being arranged to form a load edge and fulcrum for the cable, and a center section disposed between the side plates substantially mid-way between the front edge and rear edge and spaced from the front section to form the through passage of the first guide means, and provided with a recess, the block of the lock means being arranged in the recess with the groove of the block opening toward the front section.

5. A structure as defined in claim 4, wherein the body member further includes a sheave disposed between the side plates at the rear edges and forming the right-angle lead-in for the working line, and the control surface being a pin also disposed extending between the side plates at the rear edge thereof.

6. A self-locking cable trolley, comprising, in combination:

a. a body member including first guide means for receiving a cable on which the body member rides and guiding the body member along the cable, and second guide means for receiving a length of a working line;

b. lock means included in the first guide means for selectively retaining the body member at a predetermined position on the cable; and c. control means included in the second guide means and responsive to positioning of the working line for selectively actuating the lock means and retaining and releasing the body member relative to the cable, the control means including a control surface about which the working line is pressed in order to pull the lock means away from the cable, the control means further including a right-angle lead-in provided in the body member for bending the working line, the lead-in providing a bearing surface for the working line at substantially right angles to a guiding direction of the first guide means and forming a means for permitting the working line to swing the body member about the cable and engage the lock means with the cable when the working line is free of the control surface.

7. A structure as defined in claim 6, wherein the first guide member includes a through passage provided in the body member, with the lock means including a block of resilient material provided with a groove and arranged for grippingly receiving the cable.

8. In combination with a working line connected to the luff of a sail, a self-locking cable trolley mounted on a head stay cable of a sailboat and guiding the working line for permitting sag in the sail to be drawn up to the head stay cable, the trolley comprising, in combination:

a. a body member including first guide means for receiving the head stay cable on which the body member rides and guiding the body member along the cable, and second guide means for receiving the working line;

b. lock means included in the first guide means for selectively retaining the body member at a predetermined position on the cable; and c. control means included in the second guide means and responsive to positioning of the working line for selectively actuating the lock means and retaining and releasing the body member relative to the cable.

9. A structure as defined in claim 8, wherein the first guide member includes a through passage provided in the body member, with the lock means including a block resilient material provided with a groove arranged for grippingly receiving the cable, and wherein the control means includes a control surface about which the working line is pressed in order to pull the lock means away from the cable and release the lock means from the cable.

10. A self-locking cable trolley, comprising, in combination:

a. a length of a working line connected directly to the luff fo a jib sail for permitting sag in the sail to be drawn up to a head stay cable associated with the jib; and b. guide means mounted on the head stay cable for receiving the length of working line and permitting the working line to draw the luff of the sail up to the head stay cable.

* * * * *